United States Patent [19]

Gibson

[11] 4,266,407

[45] May 12, 1981

[54] PORTABLE COOLER

[76] Inventor: David E. Gibson, 3400 W. 1st Pl. Apt. 17, Kennewick, Wash. 99336

[21] Appl. No.: 114,291

[22] Filed: Jan. 22, 1980

[51] Int. Cl.[3] ..... F25D 3/08; F25D 3/10

[52] U.S. Cl. ..... 62/371; 62/457; 62/529; 62/430; 206/545

[58] Field of Search ..... 62/371, 372, 457, 529, 62/530, 430; 220/4 E; 206/545

[56] References Cited

U.S. PATENT DOCUMENTS

| | | | |
|---|---|---|---|
| 2,648,954 | 8/1953 | Wheeler et al. | 62/371 |
| 3,138,254 | 6/1964 | Knapp | 206/545 |
| 3,262,283 | 7/1966 | Taylor | 62/372 |
| 3,263,806 | 8/1966 | Ring | 206/139 |
| 3,401,535 | 9/1968 | Palmer | 62/457 |
| 3,436,932 | 4/1969 | Paquin | 62/457 |
| 3,605,435 | 9/1971 | Taylor | 62/371 X |
| 3,705,222 | 12/1972 | Rogers et al. | 206/545 X |
| 3,802,220 | 4/1974 | Pompo | 62/457 X |
| 3,848,766 | 11/1974 | Gantt et al. | 220/9 F |
| 3,859,819 | 1/1975 | Kaplan | 62/371 |
| 3,974,658 | 8/1976 | Starrett | 62/371 |
| 4,119,248 | 10/1978 | Butler | 220/339 X |

*Primary Examiner*—Lloyd L. King

*Attorney, Agent, or Firm*—Wells, St. John & Roberts

[57] ABSTRACT

A portable cooler that maintains a desired low temperature for beverages within conventional consumer containers. The cooler is made up of two molded insulating storage container halves, having matching indentations for receiving a number of beverage containers. The halves close over the containers, bringing a previously refrigerated, removable cold pack into contact with the enclosed containers. The beverage containers are thus cooled by direct contact with the cold pack and by direct contact with one another. The joined halves are removably received within a pocket of a fabric carrier that allows the entire unit to be hand-held or carried on the belt of the user.

10 Claims, 4 Drawing Figures

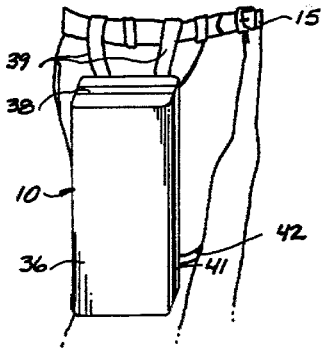
FIG 2
FIG 1
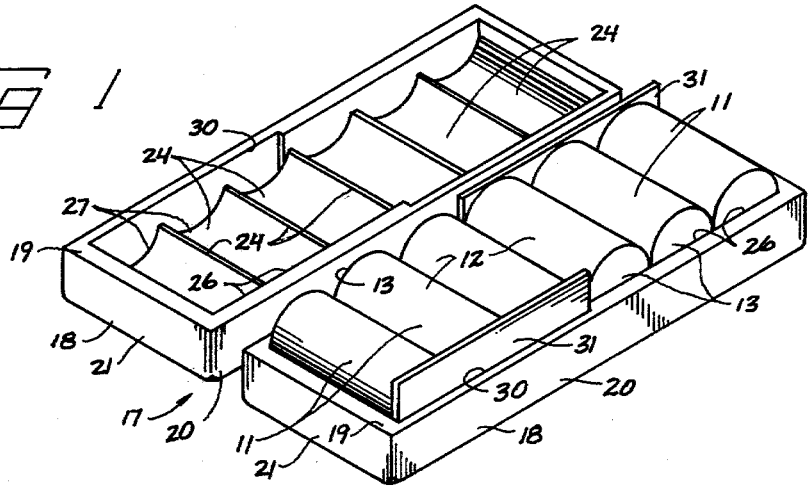
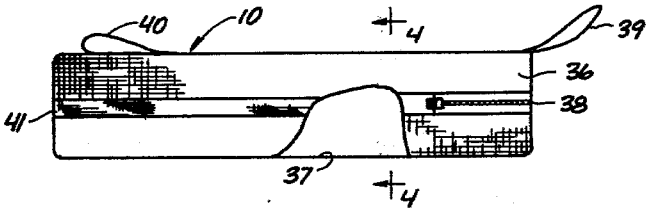
FIG 3
FIG 4
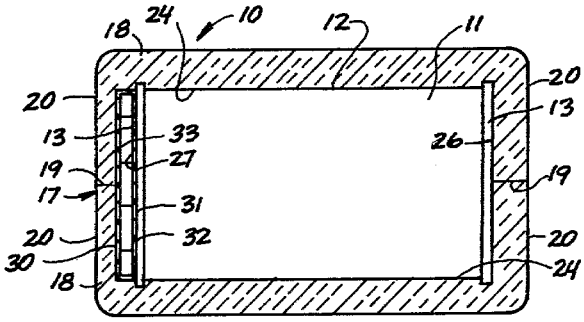

PORTABLE COOLER

BACKGROUND OF THE INVENTION

The present invention relates to portable coolers for beverage containers and more particularly to such coolers having integral cooling means.

Many different forms of beverage can and bottle coolers have been produced since the development of lightweight plastic heat insulative materials. Plastic materials have been developed that are structurally stable in addition to having excellent heat insulation qualities.

Aside from conventional "ice chests", most portable units for receiving a prescribed number of beverage cans or bottles rely entirely upon the insulative quality of the "cooler" to keep previously refrigerated beverages cool. Typically, no other provision is made for further cooling the contents of for otherwise extending the period through which the beverage is to be kept cool. Portability becomes a problem with bulky conventional coolers, even those designed specifically for carrying a small number of cans or bottles.

U.S. Pat. No. 3,401,535 to G. L. Palmer discloses a cooling container for beverages and the like. Palmer shows a container receiving body that is hollow and sealed, containing a refrigerant. The entire cooler, except for the lid, must be placed within a freezer or refrigerator for the purpose of cooling the refrigerant. If the walls of the "cooler" are insulated, freezing of the contents will take a substantially long time. The cooler must occupy a substantial amount of space within the freezer or refrigerator for an extended period of time before the refrigerant will cool sufficiently or freeze.

Beverage containers are carried by the Palmer device in six indentations formed in two groups within the container. The element including the indentations is disclosed as being a formed polystyrene, polypropylene, or polyethylene material, any of which is a poor conductor of heat. Heat transfer between the cans to the coolant is therefore hindered through the walls of the can receiving element.

U.S. Pat. No. 3,859,819 to Kaplan discloses a refrigerant-containing sandwich storage device of a nature similar to the Palmer device, in that the entire device must be refrigerated to cool or freeze an integral, enclosed refrigerant material. Kaplan, however, is intended specifically for carrying sandwiches.

U.S. Pat. No. 4,119,248 to Butler et al discloses a portable insulated carrier for beverage cans including a shoulder strap. The carrier, similar to a binocular case, isolates three or more beverage cans within a formed synthetic resin insulation material. No provision is made for further cooling or for maintaining the cool condition of the containers beyond that available due to the insulative capability of the carrying case.

U.S. Pat. No. 3,848,766 to Ganti et al illustrates an insulated container that is somewhat similar to the Butler container. The Ganti container is used to isolate a series of beverage containers within a "styrofoam" block. Ganti also includes smaller individual cups for holding the individual beverage containers. These cups are removable from the primary insulative container and serve to insulate the hand of the user from the cold beverage container, or they can be used as cups for receiving the beverage.

U.S. Pat. No. 3,263,806 to F. D. Ring discloses a tubular insulated container for beverage bottles. Ring discloses stacked storage of containers within a cylindrical tube having a spring at one end that depresses with the weight of the beverage containers. When the insulated top is removed, a single container will become exposed at the open tubular top. No provision is shown described for enabling cooling in addition to the insulative capabilities of the tubular container and its end closures. Ring also discloses a shoulder carrying strap.

The present invention is a distinct improvement over the above-described prior art in a simple yet efficient means by which beverage containers enclosed within the cooler can be cooled by conduction through direct contact with selectively-frozen cold packs. The cold packs are relatively small and completely removable from the cooler unit so they may be placed in a freezer without occupying excessive space. The small cold pack units, when fitted into the container, directly abut the ends of beverage cans within the container. They therefore cool the cans through conduction. Conduction is further assisted by direct contact between adjacent cans within the container. The entire container is receivable within a fabric carrier having loops that permit mounting to the user's belt. Such mounting frees the user's hands for other purposes and does not hinder movement as do similar sized containers carried on a shoulder strap.

BRIEF DESCRIPTION OF THE DRAWINGS

FIG. 1 is a pictorial view showing the present cooler mounted to a user's belt;

FIG. 2 is a pictorial view showing the container halves opened, with beverage cans held in one of the halves;

FIG. 3 is a side view of the present cooler; and

FIG. 4 is an enlarged sectional view taken along line 4—4 in FIG. 3 without showing the fabric pocket of the carrier shown in FIG. 3.

DETAILED DESCRIPTION OF A PREFERRED EMBODIMENT

The present cooler is generally designated in the drawings by the reference numeral 10. The cooler 10 was conceived preferably for carrying can type beverage containers such as those shown at 11. Though the present cooler is useful primarily for the purpose of carrying cans, it can also be used for carrying and cooling beverage bottles. Therefore, the term "cans" in this description is used broadly to also include bottles or other forms of beverage container.

For purposes of description, the cans 11 each have cylindrical sides 12 and parallel transverse ends 13. The cylindrical sides 12 have constant diameters, equal from one can to another. The length along the can axes between parallel ends 13 is also equal from one can to another.

The cooler includes as a basic element, a molded storage container 17. The storage container 17 is formed of two separable halves 18 for encasing the cans and insulating them against the exterior temperature. The storage container 17 is preferably formed of lightweight plastic insulating material such as expanded polystyrene beads, polyurethane foam, or other appropriate physically or chemically foamable plastic having high heat insulative properties.

The storage container 17 presents an elongated rectangular configuration when the halves 18 are assembled together. It is preferred that the container 17 have sufficient length to receive and adequately insulate a "six pack" of beverage cans. However, the number of cans received by the present cooler can vary as a matter of manufacturing choice. The "six pack" configuration is preferred, however, since many beverages are sold in units of six.

The container halves are shown in substantial detail by FIGS. 2 and 4. The halves 18 are separable along a median plane defined by oppositely facing planar joint surfaces 19. The surfaces 19 extend longitudinally through the center of the storage container, dividing it into two equal halves. The joint surfaces 19 extend transversely between upright sides 20 and longitudinally between opposed ends 21.

Each of the halves 18 includes a number of indentations 24 that are equal to the number of cans to be received. The indentations 24 are semi-cylindrical and concave, complementary to the cylindrical configuration of the cans to be received. The semi-cylindrical indentations are formed along axes that are parallel to one another and lie along the planes defined by the joint surfaces 19.

The indentations 24 are spaced by dividers 25 along each of the halves 18. These dividers are not coplanar with the joint surfaces 19, but rather are spaced outwardly therefrom. When the halves 18 are joined together, the dividers 25 define a gap or open area into which the can sides 12 extend to touch tangentially. One can 11 will therefore tangentially engage an adjacent can 11 so heat can be transmitted between the two by conduction. The indentations 24 are arranged so that each can held therein will touch an adjacent can.

One end of each indentation 24 terminates at an end surface 26. The end surfaces 26 abut can ends 13 to align the cans in a row with their ends 13 situated in parallel planes (FIG. 2). The remaining ends 27 of the indentations 24 open directly into cold pack receiving recesses 30.

The recesses 30 are provided adjacent opposite sides 20 of the cooler 10 in open communication with the indentations 24. The recesses 30 are designed to receive complementary shaped cold packs 31. Each of the recesses 30 extends longitudinally, spanning the diameters of several cans 11. Each recess 30 will preferably cover one-half (or three) of the cans ends. Both recesses could, however, be extended to include the full length of the combined indentations 24.

Cold packs 31 are provided as means for cooling and maintaining a low temperature through direct contact with the beverage cans. The cold packs 31 can be selectively removed to be frozen and subsequently reinserted within the recesses. The cold packs 31 are complementary to the recesses 30 so they may be held in direct physical contact with the cans received by the indentations 24. The cold packs 31 can therefore cool the can contents by conduction.

The cold packs may be formed by hollow sealed cases 32 enclosing a refrigerant 33. Each cold pack 31 is oblong, preferably rectangular with a width equal to or greater than the diameter of the cans and a length equal to a multiple of the can diameters, preferably three. The thickness of the cold packs 31 can vary over a considerable range but is preferably maintained relatively narrow in order to minimize weight and bulk of the filled container 17. A thickness dimension of between $\frac{1}{4}$ and $\frac{1}{2}$ inches can be used without adding significantly to the weight and bulk of the cooler.

The entire storage container 17 including its contents is releasably receivable within a fabric carrier 36. The carrier 36 is preferably formed of a flexible synthetic fabric such as nylon that is tough and lightweight. The carrier 36 provides a pocket 37 within the fabric material that is complementary in shape to the rectangular elongated storage container 17. One end of the pocket 37 includes a zippered closure 38 that allows insertion and removal of the storage container.

An elastic strip 41 extends about the bag from the start of zipper 38 to its finish. The strips 41 hold the bag tightly over the storage container and therefore keep the joint surfaces 19 in firm flush contact.

Adjacent the zipper end of the bag is a pair of belt loops 39 provided as a strap means for enabling selective attachment of the carrier and the enclosed storage container to a user's clothing. Specifically, the belt loops 39 can be utilized as hand holds or can be mounted to the user's belt 15 as shown in FIG. 1. The belt mounting, of course, frees the user's hands for other purposes. A holding strap 40 is affixed to the bag at an end thereof opposite the zippered end. The strap 40 can be used for strapping the cooler to one's leg with a leg strap 42 (FIG. 1). The strap 40 can also be used in conjunction with straps 39 to mount the cooler to handlebars on the crossbar of a bicycle.

Prior to using the present invention, the cold packs 31 are removed from their respective recesses 30 and are placed in a freezer or refrigerated area. The cold packs 31 will occupy very little space within the refrigerator and will not require substantial energy or extended time for freezing. It is also desirable to refrigerate the beverages during the time the cold packs 31 are being refrigerated. Previously cooled contents will not transfer a great amount of heat through conduction to the cold packs 31 and therefore will remain cooler over a longer period of time.

Refrigerated cold packs 31 are placed in their respective recesses 30 and the cans 11 are positioned one into each indentation 24. An end of each can 11 will directly engage one or the other of the cold packs 31. The container halves 18 are then put together with the facing joint surfaces 19 abutting one another. The assembled container 17 can then be inserted into the fabric carrier 36 and the pocket 37 can be zippered closed. The full carrier is now transportable by hand or on the belt 15 of the user for an extended period of time before the enclosed beverage cans 11 return to the external ambient air temperature.

Any of the cans can be retrieved simply by unzipping the closure 38 and pulling the container 17 from the pocket. The halves are then opened allowing free access to the cans.

Heat is transferred through the cans themselves and into the frozen cold packs 31 by conduction. Typically, the beverage cans are constructed of aluminum which is a very good heat conductive material. An efficient means of cooling the container contents is therefore established within a very compacted and lightweight cooler.

It is pointed out that the above description and attached drawings are given by way of example to set forth a preferred form of the present invention. Other forms not illustrated or described are contemplated within the scope of the attached claims.

What I claim is:

1. A portable beverage cooler, comprising:

a molded storage container formed in two separable halves adapted to be arranged facing inwardly and in abutment with one another for selectively encasing a prescribed number of beverage containers, each storage container half having a number of beverage container receiving indentations for receiving an equal number of beverage containers with opposite ends of the beverage containers located along parallel planes and with adjacent beverage containers physically contacting one another;

said molded storage container being formed of a lightweight heat insulative material;

a recess formed in at least one of the storage container halves adjoining and in open communication with one end of the indentations therein; and cold pack means removably received within the recess and selectively removable to be frozen, then subsequently reinserted within the recess to physically engage beverage containers within the indentations for cooling the contents of the beverage containers by conduction.

2. The cooler as defined by claim 1 further comprising:

a fabric carrier having a pocket formed therein for removably receiving the molded storage container.

3. The cooler as defined by claim 2 wherein the fabric carrier includes strap means thereon for enabling selective attachment of the carrier and enclosed molded storage container to a user on his clothing.

4. The cooler as defined by claim 1 wherein the indentations are concave and spaced apart on parallel axes so adjacent beverage containers received within the indentations will contact one another tangentially.

5. The cooler as defined by claim 1 wherein there are two recesses and two cold pack means, with one recess situated adjacent one side of the indentations for holding one of the cold pack means against a number of beverage containers, and with the remaining recess being situated adjacent an opposite side of the indentations for holding the remaining cold pack means against an equal number of beverage containers.

6. The cooler as defined by claim 1 wherein the indentations are semi-cylindrical, formed on parallel, equally spaced axes and wherein the storage container halves are joined along surfaces that lie along planes including the indentation axes.

7. The cooler as defined by claim 1 for cylindrical cans having equal outside diameters, wherein said cold pack means is comprised of a rectangular vessel containing a refrigerant having a width dimension equal to the diameter of the cans and a length dimension equal to a multiple of can diameters.

8. The cooler as defined by claim 1 wherein said cold pack means is comprised of a hollow oblong case containing a refrigerant and having a length dimension spanning several of said indentations.

9. The cooler as defined by claim 1 wherein said storage container is rectangular and removably received within a pocket of a fabric carrier, said carrier having a zippered closure for allowing access to the container and belt loops at an end thereof adapted to be threaded over a belt at the waist of a user.

10. The cooler as defined by claim 2 wherein the fabric carrier includes a zipper closure at one end of said pocket and an elastic strap extending about the fabric carrier from one end of the zipper closure to an opposite end, allowing the fabric carrier to receive and securely hold the storage container halves together.

* * * * *